United States Patent [19]

Ota et al.

[11] Patent Number: 4,649,282

[45] Date of Patent: Mar. 10, 1987

[54] SMOKE SENSING APPARATUS OF THE LIGHT SCATTERING TYPE

[75] Inventors: Kazuomi Ota, Anjo; Minoru Kato, Ichinomiya; Seiichi Narita, Kariya; Mitutoshi Moriya, Gamagori, all of Japan

[73] Assignee: Nippondenso Co., Ltd., Kariya, Japan

[21] Appl. No.: 698,545

[22] Filed: Feb. 5, 1985

[30] Foreign Application Priority Data

Feb. 14, 1984 [JP] Japan ..... 59-26844

[51] Int. Cl.[4] ..... G08B 17/10

[52] U.S. Cl. ..... 250/574; 340/630

[58] Field of Search ..... 250/573, 574, 575, 564, 250/565; 340/630; 356/438, 439

[56] References Cited

U.S. PATENT DOCUMENTS 3,917,956 11/1975 Malinowski ..... 340/630

4,297,688 10/1981 Kakigi ..... 250/574

4,308,531 2/1981 Yamamoto ..... 340/630

4,528,555 7/1985 Yasukawa ..... 340/630

*Primary Examiner*—Edward P. Westin

*Attorney, Agent, or Firm*—Cushman, Darby & Cushman

[57] ABSTRACT

In a smoke sensing apparatus, a light receiving circuit including a light receiving element senses light emitted from a light emitting circuit including a light emitting element and scattered by smoke, and a voltage holding circuit converts the output signal of the light receiving circuit into a d.c. voltage and holds the d.c. voltage. A mean value circuit averages the voltage signal from the voltage holding circuit, and a switching circuit acts to bring the output of the mean value circuit to a level close to that of the output of the voltage holding circuit. A comparison circuit compares the output of the means value circuit with the output of the voltage holding circuit thereby generating a control signal.

19 Claims, 8 Drawing Figures

SMOKE SENSING APPARATUS OF THE LIGHT SCATTERING TYPE

FIELD OF THE INVENTION

This invention relates to the art of signal processing in a smoke sensing apparatus of the type sensing smoke on the basis of the quantity of light scattered by the smoke, and more particularly to an apparatus of the type described above which is suitable for use in, for example, an automobile for automatically starting operation of an air conditioner provided in the automobile.

BACKGROUND OF THE INVENTION

A prior art smoke sensing apparatus of the above type has such a construction that light emitted from a light emitting element and scattered by smoke is converted by a light receiving element into an electrical signal which is applied, after being amplified by an amplifier, to a comparator to be compared with a predetermined level. The comparator generates a control signal actuating an air conditioner when the level of the comparator input signal becomes higher than the predetermined level. However, the prior art smoke sensing apparatus has had the following problems: Firstly, the sensitivity of the smoke sensing apparatus tends to change depending on the temperature due to temperature-dependent variations of the characteristics of the elements including the light emitting and receiving elements and amplifier. Secondly, the level of the comparator input signal tends to vary due to degradations or secular variations of the characteristics of the light emitting and receiving elements due to a change in the quantity of reflected light not attributable to smoke, resulting in a reduced sensitivity or mal-operation of the apparatus due to the signal level variation.

SUMMARY OF THE INVENTION

With a view to solve the prior art problems points out above, it is a primary object of the present invention to provide a smoke sensing apparatus in which signal processing means are provided so that a high sensitivity can be stably maintained even when a signal level variation not attributable to smoke occurs.

DESCRIPTION OF THE PREFERRED EMBODIMENTS

Figure 1:
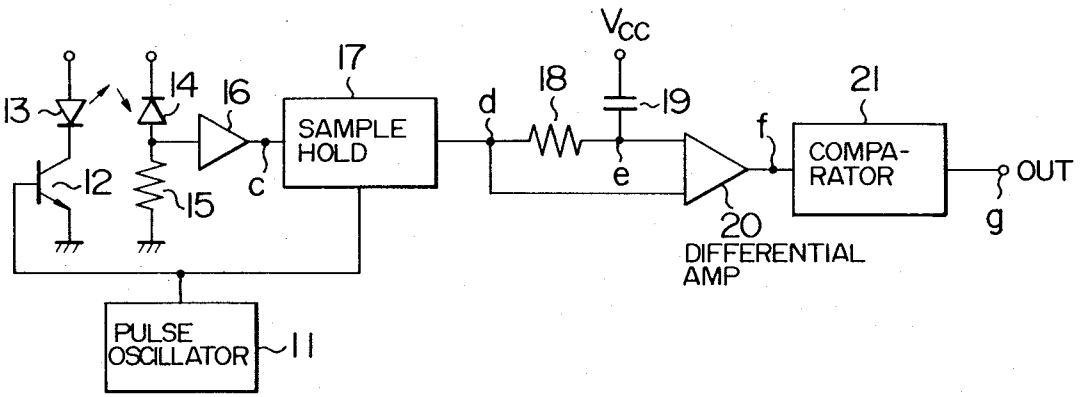
FIG. 1 is an electrical connection diagram showing the structure of a first embodiment of the smoke sensing apparatus according to the present invention.

Referring to FIG. 1, a first embodiment of the smoke sensing apparatus according to the present invention comprises a pulse oscillator 11, a switching element 12, a light emitting element 13, a light receiving element 14, a resistor 15 for generating a signal voltage, an amplifier 16, a sample and hold circuit 17, an integrating resistor 18, an integrating capacitor 19, a differential amplifier 20, and a comparator 21.

Figure 2:
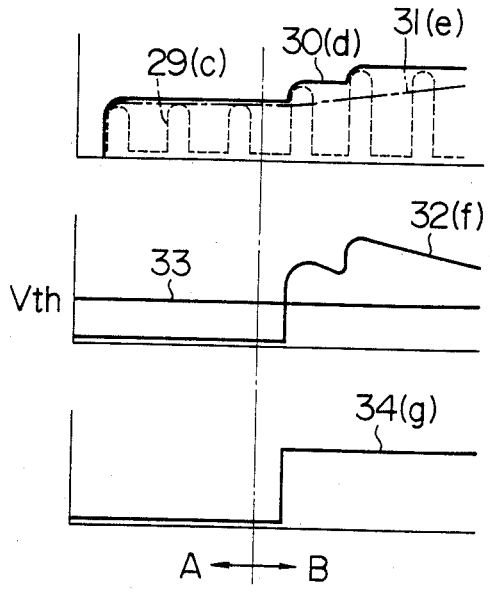
FIG. 2 is a time chart illustrating the operation of the apparatus shown in FIG. 1.

FIG. 2 is a time chart showing voltage waveforms appearing at various points of the circuit shown in FIG. 1. Curves 29, 30, 31 and 32 represent voltage waveforms appearing at points c, d, e and f in FIG. 1 respectively. A line 33 and a curve 34 represent a reference voltage applied to the comparator 21, and an output signal or control signal appearing at a point g (the output terminal) respectively.

With a view to obviate the prior art problems, that is, the temperature-dependent sensitivity change, th degradations or secular variations of the light emitting and receiving elements and the change in the quantity of light reflected inside the sensor, the present invention contemplates to effectively compensate such variations for ensuring that the smoke sensing apparatus can operate with a high sensitivity. Referring to FIG. 1, light emitted from the light emitting element 13 is reflected by dust particles such as those of smoke, and the reflected light incident upon the light reception part of the light receiving element 14 is converted into an electrical signal. The light emitting element 13 is actuated by a pulse signal applied from the pulse oscillator 11 through the switching element 12 so that it can generate a high optical output without being shortened in its useful service life. The electrical output signal appearing from the light receiving element 14 is converted by the resistor 15 into a voltage signal which is amplified by the amplifier 16. The resultant output signal of the amplifier 16 appearing at the point c has a waveform as shown by the dotted curve 29 in FIG. 2.

Such an output signal of the amplifier 16 is sampled in the sample and hold circuit 17 by the output of the oscillator 11 in synchronism with the optical output generation timing of the light emitting element 13. The resultant output signal of the sample and hold circuit 17 appearing at the point d has a waveform as shown by the solid curve 30 in FIG. 2. The voltage output signal of the sample and hold circuit 17 charges the capacitor 19 with a large time constant through the resistor 18, and the resultant voltage output signal appearing at the point e has a waveform as shown by the one-dot chain curve 31 in FIG. 2.

The section A in FIG. 2 corresponds to the absence of any smoke. It will be seen that the output voltage of the sample and hold circuit 17 appearing at the point d (the curve 30 in FIG. 2) does not change, and, since the capacitor 19 is full charged in such a case, the voltage appearing at the point e (the curve 31 in FIG. 2) is equal to that appearing at the point d. On the other hand, the section B in FIG. 2 indicates indicates the condition when smoke intervenes in the sensor part of the smoke sensing apparatus thereby increasing the quantity of reflected light. Consequently, the output voltage of the amplifier 16 appearing at the point c (the curve 29 in FIG. 2) increases, and the output voltage of the sample and hold circuit 17 appearing at the point d (the curve 30 in FIG. 2) increases correspondingly. At the same time, the capacitor 19 discharges through the resistor 18 to increase the voltage level appearing at the point e (the curve 31 in FIG. 2). However, this voltage increase is slow and gradual since the time constant is selected to be large.

The voltage appearing at the point e is applied to the differential amplifier 20 together with the voltage appearing at the point d. The differential amplifier 20 amplifies the voltage differential. Therefore, its output voltage appearing at the point f has a waveform as shown by the solid curve 32 in FIG. 2. When this output voltage exceeds the reference voltage $V_{th}$ (represented by the line 33 in FIG. 2) of the comparator 21, the comparator output signal (the curve 34 in FIG. 2) indicative of sensed smoke appears at the point g as a control signal.

Although the voltage appearing at the point d may be subject to a gradual change owing to the sensitivity change due to the temperature-dependent variations of the characteristics of the light emitting and receiving elements and amplifier, the degradations or secular variations of the characteristics of the light emitting and receiving elements after a long time of use, and the change in the quantity of reflected light inside the sensor, the voltage appearing at the point d is equal to the voltage appearing at the point e in the absence of smoke. Therefore, no output appears from the differential amplifier 20 in the absence of smoke, and, only when the voltage at the point d increases for a short length of time due to intervention of smoke does the the differential amplifier 20 generate its output. Thus, the smoke sensing apparatus of the present invention can operate with the desired high sensitivity over a long period of time without the necessity for inspection and repair.

Figure 3:
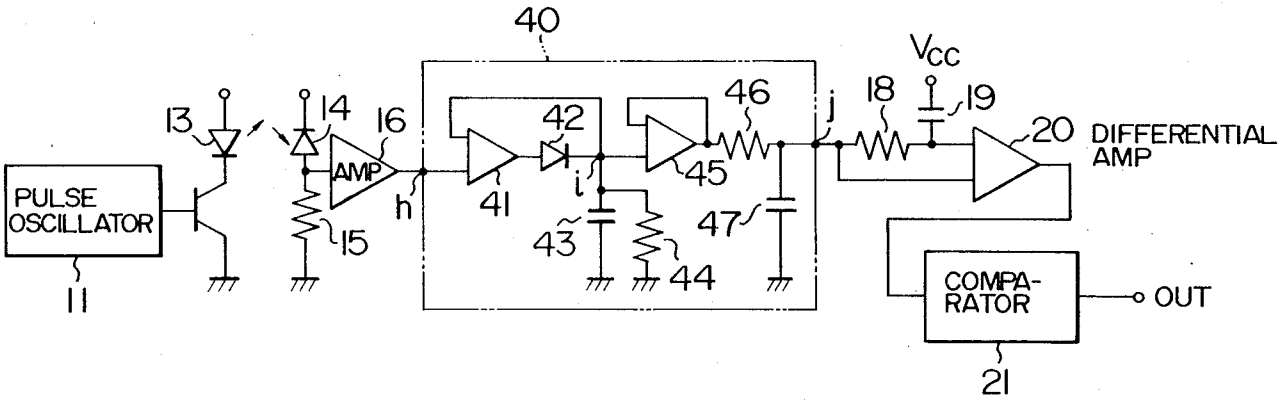
FIG. 3 is an electrical connection diagram showing the structure of a second embodiment of the present invention.
Figure 4:
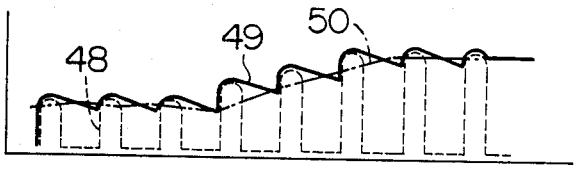
FIG. 4 is a time chart illustrating the operation of the apparatus shown in FIG. 3.

FIG. 3 shows a second embodiment of the present invention. In FIG. 3, the same reference numerals are used to designate the same parts appearing in FIG. 1. In the first embodiment, the pulse output of the amplifier 16 is converted into the d.c. voltage by the sample and hold circuit 17. In the second embodiment shown in FIG. 3, a peak hold circuit 40 including an operational amplifier 41, a diode 42 and a capacitor 43 together with a discharge resistor 44 is provided for converting a pulse waveform 48 into a saw-tooth waveform 49 as shown in FIG. 4. Then, the combination of a second operational amplifier 45, a second resistor 46 and a second capacitor 47 smoothes the saw-tooth waveform 49 into a d.c. voltage waveform 50 as shown in FIG. 4. Thus, the second embodiment achieves the effect similar to that exhibited by the first embodiment.

Figure 5:
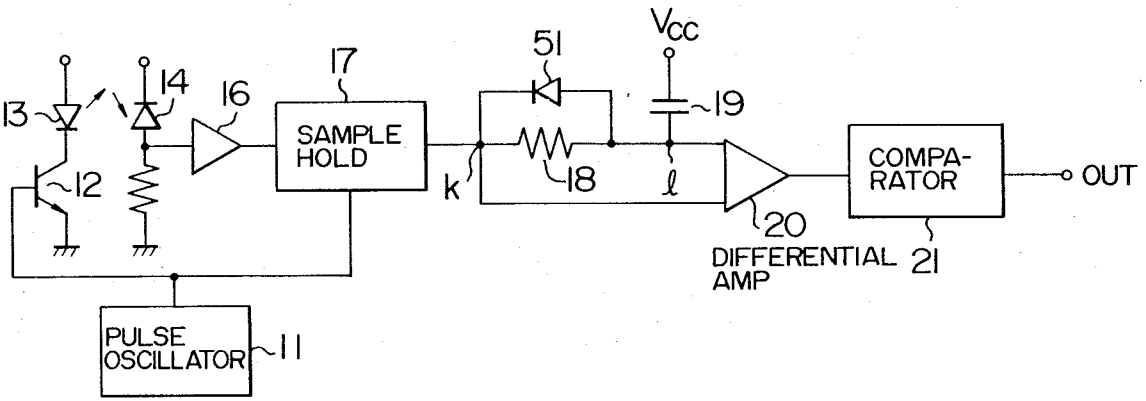
FIGS. 5 and 6 are electrical connection diagrams showing the structure of a third embodiment and a fourth embodiment respectively of the present invention.
Figure 6:
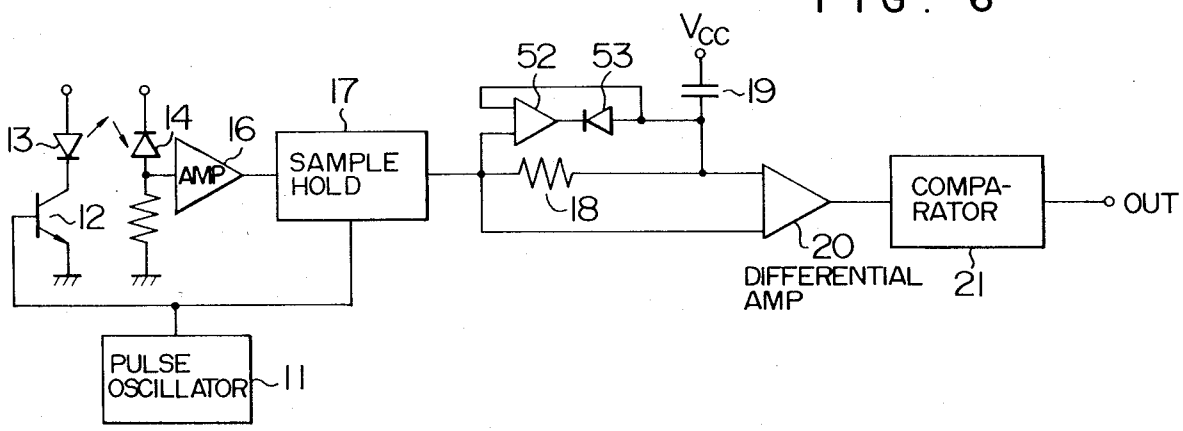

FIGS. 5 and 6 show a third embodiment and a fourth embodiment respectively of the present invention. In FIGS. 5 and 6, the same reference numerals are used to designate the same parts appearing in FIG. 1. In each of the third and fourth embodiments, a circuit for instantaneously charging the capacitor 19 in response to the turning-on of the power supply is added so that smoke can be sensed with a high sensitivity as soon as the power supply is turned on. In the case of the first embodiment shown in FIG. 1, the capacitor 19 is not charged at the time of turning-on of the power supply. As soon as the power supply is turned on, the voltage at the point e starts to gradually approach the voltage at the point d as shown by the solid curve 55 in FIG. 7. Until the voltage at the point e attains the level of the voltage at the point d, no output appears from the differential amplifier 20, since it does not quickly respond to a slight increase in the voltage at the point d when the quantity of smoke is slight.

Figure 7:
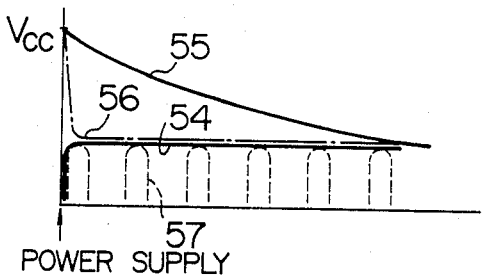
FIG. 7 is a time chart illustrating the operation of the apparatus shown in FIGS. 5 and 6.

In contrast, in the third embodiment in which a diode 51 is connected in parallel with the resistor 18, the capacitor 19 is charged as soon as the power supply is turned on, and the voltage at a point 1 becomes immediately equal to the voltage at a point k as shown by the one-dot chain curve 56 in FIG. 7, so that smoke present in a very slight quantity can be reliably sensed. In the fourth embodiment shown in FIG. 6, an operational amplifier 53 is connected in series with a diode 52 so that even the forward voltage of the diode can be ignored.

It is apparent that the function of part of the constituent elements of the aforementioned embodiments may be replaced by programmed processing by a digital computer.

Figure 8:
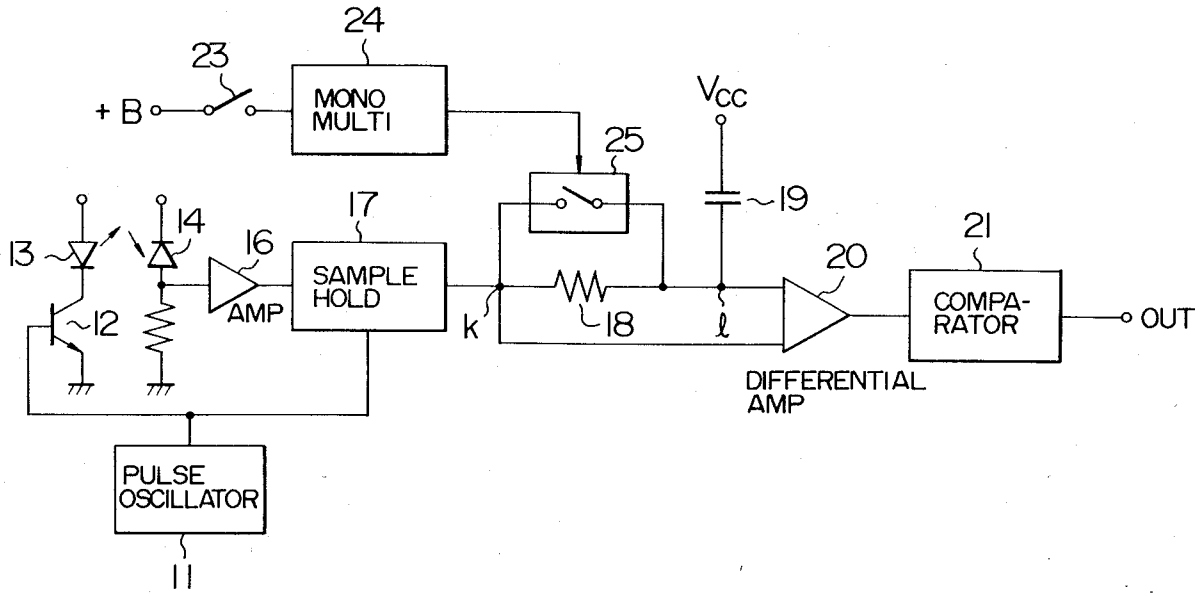
FIG. 8 is an electrical connection diagram showing the structure of a fifth embodiment of the present invention.

FIG. 8 shows a fifth embodiment of the present invention. In FIG. 8, the same reference numerals are used to designated the same parts appearing in FIG. 1. Referring to FIG. 8, in response to the turning-on of an ignition key switch 23, the battery voltage +B is applied to a regulated voltage circuit (not shown) which applies a voltage regulated at a value required for operation of various circuits of the smoke sensing apparatus, thereby placing the smoke sensing apparatus in operation.

On the other hand, in response to the turning on of the ignition key switch 23, a monostable multivibrator 24 is triggered to generate a time signal including pulses having a pulse period of about 1 sec. In response to the application of this time signal, an analog switch 25 is closed at the time interval of about 1 sec. Therefore, in a short period of time after the turning-on of the key switch 23, the output voltage of the mean value circuit appearing at a point 1 equals the sensed voltage appearing at a point k, and, then, the apparatus starts its smoke sensing operation described above.

We claim:

1. A smoke sensing apparatus comprising:

a light emitting circuit including light emitting means for emitting a predetermined light;

a light receiving circuit including light receiving means for sensing a portion of light emitted from said light emitting circuit and producing an output signal indicative thereof, an amount of light sensed by said light receiving means indicative of an amount of smoke between said light emitting circuit and said light receiving circuit;

voltage holding means for converting the output signal of said light receiving circuit into a voltage signal and for maintaining the voltage signal at substantially a constant level;

mean value means for averaging the voltage signal applied from said voltage holding means, said mean value means including a resistor and a capacitor in series between said voltage signal of said voltage holding means and a power supply terminal, a junction point between said resistor and said capacitor forming an output terminal of said mean value means which has a mean value signal thereupon;

switching means for charging an output voltage of the capacitor in said mean value means to a level close to that of the voltage signal of said voltage holding means, said switching means including a diode connected in parallel with the resistor in said mean value means so that an anode of said diode is coupled to the junction point between said resistor and said capacitor; and comparison means for comparing the mean value signal from said mean value means with the voltage signal from said voltage holding means, thereby generating a control signal indicative of a sensed amount of smoke.

2. A smoke sensing apparatus as claimed in claim 1, wherein said voltage holding means includes a sample and hold circuit.

3. A smoke sensing apparatus as claimed in claim 1, wherein said voltage holding means includes a peak hold circuit including saw-tooth generating means for generating a saw-tooth signal and filter means for filtering the saw-tooth signal of said sawtooth generating means.

4. An apparatus as in claim 1 wheren said resistor is coupled between said voltage signal of said voltage holding means and said junction, and a cathode of said diode is coupled to said voltage signal of said voltage holding means.

5. A smoke sensing apparatus as claimed in claim 4, where in said switching means includes a series connection of an operational amplifier and said diode, which series connection is connected in parallel with the resistor in said mean value means, so that an output terminal of said operational amplifier is connected to a cathode of said diode, and an anode of said diode is connected to the junction point between said resistor and said capacitor of said mean value means, and one input of said operational amplifier is connected to an input terminal of said mean value means and an other input of said operational amplifier is connected to the anode of said diode.

6. A smoke sensing apparatus comprising:

means for emitting light, including a light emitting element emitting a predetermined light;

means for receiving light, including a light receiving element sensing a portion of light emitted from said light-emitting means and scattered by smoke, thereby generating an output signal indicative of a quantity of the scattered light;

voltage holding means for converting the output signal of said light receiving means into a d.c. voltage and holding the d.c. voltage;

mean value means, including a capacitor and a resistor, for averaging the d.c. voltage from said voltage holding means, said mean value means including a resistor and a capacitor connected in series between said dc voltage of said voltage holding means and a power supply terminal, a junction point between said resistor and said capacitor serving as an output terminal of said mean value means which carries a mean value signal;

switching means for instantaneously charging the capacitor in said mean value circuit in response to a turning-on of a power supply, said switching means including a monostable multivibrator generating a time signal at a predetermined time interval in response to the turning-on of the power supply, and an analog switch connected in parallel with the resistor in said mean value means, said analog switch being connected to the junction point between the resistor and the capacitor of said mean value means, said analog switch being turned on at said predetermined time interval; and differential amplifier means for comparing the mean value signal from said mean value means with the voltage signal from said voltage holding means, thereby generating a control signal.

7. A smoke sensing apparatus as claimed in claim 6, wherein said voltage holding means includes a sample and hold circuit.

8. A smoke sensing apparatus as claimed in claim 6, wherein said voltage holding means includes a peak hold circuit including saw-tooth generating means for generating a saw-tooth signal and filter means for filtering the saw-tooth signal of said sawtooth generating means.

9. An apparatus as in claim 6 wherein said resistor is coupled between said dc voltage of said voltage holding means and said junction, and said analog switch is coupled between said dc voltage signal of said voltage holding means and said, junction point.

10. A smoke sensing apparatus, comprising:

means for emitting a predetermined light;

light receiving means, spaced from said light emitting means, for receiving light emitted by said light emitting means and producing an output signal indicative of an amount of said light received, said output signal varying based on an amount of smoke existing between said light emitting means and said light receiving means;

averaging means for averaging said output signal of said light receiving means, said averaging means including: (a) resistor means, having a first end coupled to said output signal of said light receiving means, for providing a resistive load, (b) means for storing charge, coupled between a power supply terminal and a second end of said resistor means, a junction point being formed between said second end of said resistor means and said means for storing charge, and (c) charge equalizing means, shunted in parallel across said resistor means, for selectively providing a low resistance parallel path across said resistance means when actuated into a low resistance mode for quickly altering the charge on said charge storing means, said charge equalizing means thereby selectively providing a low resistance path for charging and discharging said charge storage means; and determining means, coupled to said output terminal of said averaging means, for determining whether a smoke level exceeds a predetermined threshold based on said output signal, and for producing a control signal indicative thereof.

11. An apparatus as in claim 10 wherein said charge equalizing means is a diode having an anode coupled to said junction and a cathode coupled to said first end of said resistor means, said charge equalizing means being actuated whenever a charge on said charge storing means exceeds a level of said output signal of said light receiving means by an amount more than a forward voltage drop of said diode.

12. An apparatus as in claim 10 wherein said charge equalizing means is an analog switch and further comprising control means for selectively actuating said analog switch.

13. An apparatus as in claim 11 wherein said means for storing charge is a capacitor.

14. An apparatus as in claim 13 wherein said power supply terminal is a source of voltage and further comprising a power supply for producing said voltage.

15. An apparatus as in claim 13 wherein said light receiving means further comprises a sample and hold circuit.

16. An apparatus as in claim 15 further comprising pulse oscillator means for driving said light emitting means and said sample and hold circuit in synchronism with one another.

17. An apparatus as in claim 16 further comprising differential amplifier means having one input connected to said output terminal of said averaging means and another input terminal connected to the output terminal of said light receiving means, for producing an output signal indicative of a smoke detection when an output voltage of said sample and hold means exceeds a voltage on said output terminal of said averaging means by a predetermined amount.

18. A smoke sensing apparatus for sensing smoke by detecting light scattered by the smoke, comprising:

a pulse oscillator;

means for emitting light, including a switching element driven by the pulse oscillator and a light emitting element driven by the switching element, said light emitting means emitting the light in the form of successive pulses;

light receiving means for receiving an increased amount of light reflected by smoke particles when smoke is present and for producing an output signal indicative of an amount of light received;

sample and hold means, connected to said light receiving element and driven by said pulse oscillator in synchronism with the emission of the light by said emitting means, for converting a pulse-shaped output from said light receiving means into a d.c. voltage;

integrating means, connected to an output terminal of said sample and hold means and including a resistor and a capacitor, said resistor being connected to an output terminal of said sample and hold means, said capacitor being connected between said resistor and a power supply terminal, a junction point between said resistor and said capacitor forming an output terminal of said integrating means;

diode means for passing current only from an anode to a cathode thereof, said diode means being connected so that said cathode of said diode means is connected to said output terminal of said sample and hold means and said anode of said diode means is connected to said junction point between said resistor and said capacitor, said diode means being rendered conductive when a voltage at said junction point becomes a predetermined amount higher than a voltage at said output terminal of said sample and hold means thereby quickly reducing the voltage at said junction point to reach the voltage at said sample and hold output terminal; and differential amplifier means, having one input connected to said junction point between said resistor and said capacitor of said integrating means and another input connected directly to the output terminal of said sample and hold means, for producing an output signal as a smoke detection signal when an output voltage of said sample and hold means exceeds a voltage at said junction point of said integrating means by a predetermined amount.

19. An apparatus as in claim 18 wherein a time constant of a circuit including said resistor and capacitor is much larger than a time constant of a circuit including said diode and capacitor.

* * * * *